US008707874B2

(12) United States Patent
Ritzberger et al.

(10) Patent No.: US 8,707,874 B2
(45) Date of Patent: Apr. 29, 2014

(54) MOLDED PART FOR ACCOMMODATION AND FIXATION OF STORAGE CONTAINERS RECTANGULAR IN OUTLINE

(75) Inventors: Axel Ritzberger, Altendorf (CH); Ruediger Koehler, Suddendorf (DE)

(73) Assignee: Georg Utz Holding AG, Bremgarten (CH)

( * ) Notice: Subject to any disclaimer, the term of this patent is extended or adjusted under 35 U.S.C. 154(b) by 0 days.

(21) Appl. No.: 13/636,485

(22) PCT Filed: Mar. 16, 2011

(86) PCT No.: PCT/EP2011/001280

§ 371 (c)(1),
(2), (4) Date: Sep. 21, 2012

(87) PCT Pub. No.: WO2011/120634

PCT Pub. Date: Oct. 6, 2011

(65) Prior Publication Data

US 2013/0008814 A1 Jan. 10, 2013

(30) Foreign Application Priority Data

Mar. 29, 2010 (DE) ..... 10 2010 013 284

(51) Int. Cl.
*B65D 19/00* (2006.01)

(52) U.S. Cl.
USPC ..... 108/51.11

(58) Field of Classification Search
USPC ..... 108/51.11, 53.1, 53.3, 53.5, 55.1, 55.3, 108/56.1, 56.3, 57.1, 57.13, 57.16, 57.18, 108/57.25, 57.28
See application file for complete search history.

(56) References Cited

U.S. PATENT DOCUMENTS

| | | | | |
|---|---|---|---|---|
| 3,640,229 | A * | 2/1972 | Bell | 108/57.28 |
| 3,948,190 | A * | 4/1976 | Cook et al. | 108/53.3 |
| 4,966,084 | A * | 10/1990 | Motomaru | 108/51.3 |
| 5,144,897 | A * | 9/1992 | Avery | 108/55.3 |
| 5,487,471 | A | 1/1996 | Marchek et al. | |
| 6,837,377 | B2 * | 1/2005 | Shuert | 206/599 |
| 7,721,891 | B2 | 5/2010 | Dubois | |
| 2004/0218276 | A1 * | 11/2004 | Apps et al. | 359/582 |
| 2006/0144743 | A1 | 7/2006 | McDade | |
| 2006/0272556 | A1 * | 12/2006 | Apps | 108/53.1 |
| 2008/0295748 | A1 * | 12/2008 | Yoshida et al. | 108/55.1 |

FOREIGN PATENT DOCUMENTS

| | | |
|---|---|---|
| AU | 499 980 | 5/1979 |
| DE | 38 04 275 | 8/1989 |
| DE | 101 57 417 | 6/2003 |
| EP | 0 521 478 | 1/1993 |
| EP | 1 477 414 | 11/2004 |
| WO | WO 2005/095217 | 10/2005 |

OTHER PUBLICATIONS

International Search Report of PCT/EP2011/001280, Jul. 4, 2011.

* cited by examiner

*Primary Examiner* — Matthew Ing
(74) *Attorney, Agent, or Firm* — Collard & Roe, P.C.

(57) ABSTRACT

A molding for accommodating and fixing rectangular-outline storage containers, wherein an accommodating surface of the molding covers an even-numbered multiple of the area covered by the container surface, and in each case two containers are arranged adjacent to one another such that their facing side walls are located symmetrically in relation to the short center longitudinal axis of the molding. The underside of the molding is directed away from the accommodating surface and is provided, along the course of the center longitudinal axis, with an encompassing groove which brings together the facing side walls of two adjacent storage containers arranged beneath the molding and of which the side peripheries extend into the respective container.

5 Claims, 9 Drawing Sheets

Figure 1:
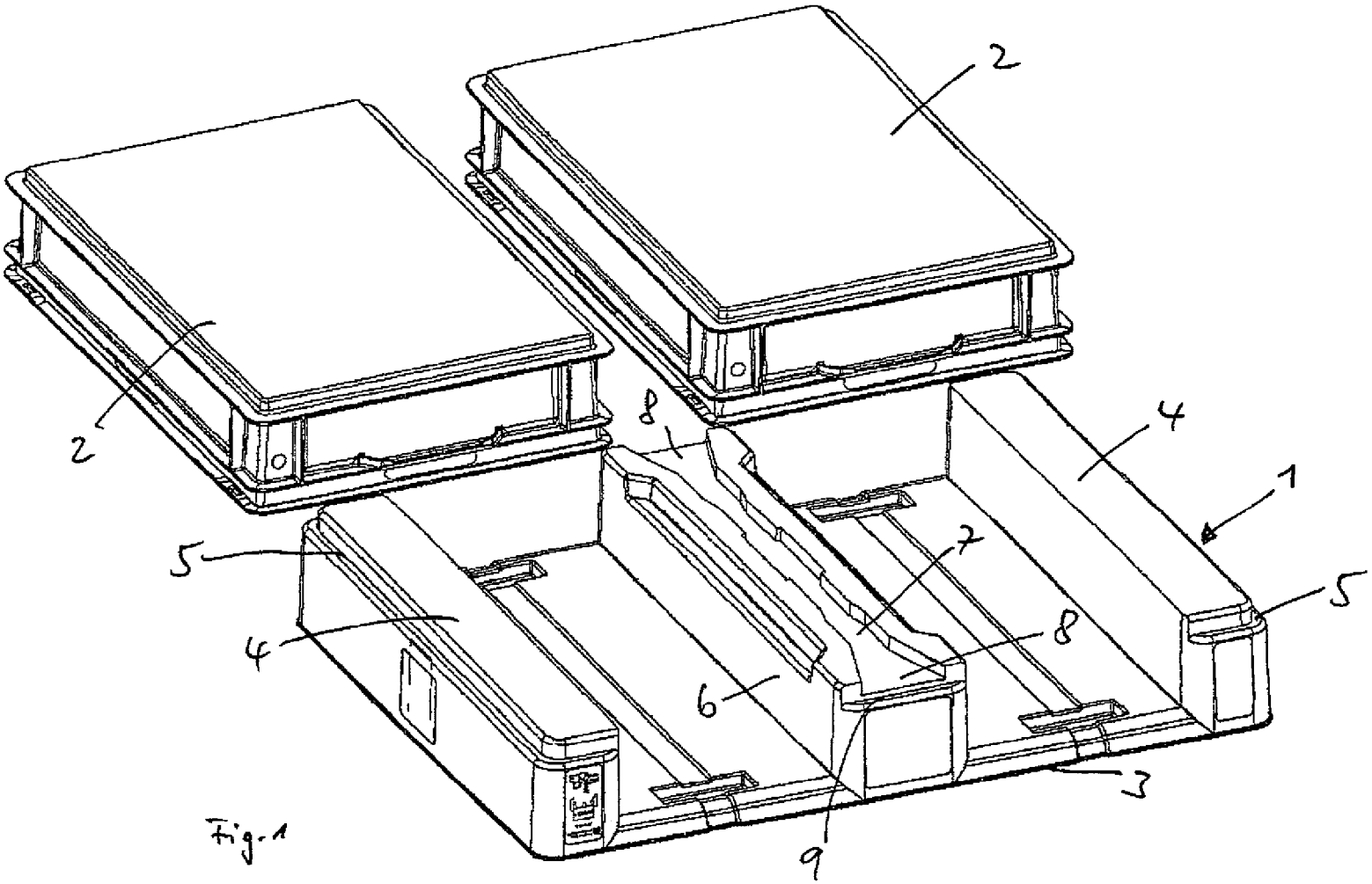

MOLDED PART FOR ACCOMMODATION AND FIXATION OF STORAGE CONTAINERS RECTANGULAR IN OUTLINE

CROSS REFERENCE TO RELATED APPLICATIONS

This application is the National Stage of PCT/EP2011/001280 filed on Mar. 16, 2011, which claims priority under 35 U.S.C. §119 of German Application No. 10 2010 013 284.5 filed on Mar. 29, 2010, the disclosure of which is incorporated by reference. The international application under PCT article 21(2) was not published in English.

The invention relates to a molded part for accommodation and fixation of storage containers rectangular in outline, wherein the accommodation surface of the molded part is an even-numbered multiple of the container surface area, and two containers, in each instance, are disposed adjacent to one another, in such a manner that their side walls that face one another lie symmetrical to the shorter center longitudinal axis of the molded part.

Such plastic containers, produced using the injection-molding method, for example, are generally delivered, in the filled state, on so-called Euro-pallets, for example to discounters.

Once the containers have been emptied, they are transported back to the vendor, combined in receptacles.

If a plurality of containers stacked on top of one another or stacked into one another are combined on normal wooden pallets, for example, for return transport, these stack arrangements do not have a secure hold to prevent slipping to the side, particularly since a regular and symmetrical arrangement on the pallet is not always guaranteed in the hectic situation of daily work at a discounter.

The invention is therefore based on the task of configuring a molded part of the type indicated initially in such a manner that for one thing, "self-centering" of the containers on the pallets takes place, and also, slipping of the containers to the side, relative to one another, is excluded.

The invention accomplishes this task in that a groove that brings together and encloses the side walls, which face one another, of two adjacent containers, in each instance, disposed below the device, is provided on the underside of the molded part, in the progression of the center longitudinal axis, the side edges of which groove reach into the container, in each instance.

For example, two containers are set onto the wooden pallet, the longitudinal walls of which containers are disposed parallel to one another, wherein two of them are adjacent to one another. If the molded part according to the invention is now set onto these two containers from above, the two adjacent longitudinal walls of the corresponding containers are pulled toward one another by means of the particular configuration of the groove, when the molded part is set down, and clamping by means of the groove walls, which reach into the container, in each instance, takes place.

Two further empty containers are then set onto the top, the accommodation surface of the molded part, and the stack is thus increased in height by means of setting a further molded part onto these.

As this goes on, a container stack that is stable in itself is formed, which merely needs to be fixed in place on the pallet by means of a belt or the like, if necessary, if the lowermost pallet is a normal Euro-pallet.

An alternative embodiment of the centering groove can be configured in such a manner that same is configured to be wedge-shaped in cross-section, and the containers are moved toward one another by means of the slants.

In a preferred embodiment of the invention, according to claim 2, however, it is provided that the groove-forming channel is widened in funnel-like manner at its ends.

Using this configuration, it is possible to set the molded part on at a slant, parallel to the shorter side walls of the containers. When the molded part is folded down onto the containers, other containers disposed farther apart from one another on the lowermost pallet can also be automatically brought together, in order to then be accommodated in the channel of the groove with their side walls that lie next to one another.

In this way, the further advantage is obtained that because containers are pushed together by means of such a conical guide, the container corners no longer project, thereby bringing about a significantly better force flow, because it is almost exclusively the corners of the containers that absorb the force.

Until now, the invention was described in the application of stacking two containers, in each instance, whereby the two containers together agree, in terms of surface area, with the accommodation surface area of the molded part.

However, the invention is not restricted to this. According to claim 3, it is provided that two grooves are provided in the center longitudinal axis, one behind the other and aligning with one another, and that the region between the channels that form the grooves is left out.

In this way, it is possible to center and fix in place four smaller containers, in precisely the same manner, whereby in this connection, two containers that lie against one another with their longitudinal walls, in each instance, make up the surface area of a larger container described above.

Thus, two of the shorter side walls of the containers now lie against one another in the center longitudinal axis of the molded part. In this connection, setting on of the molded part takes place precisely as described above. The two grooves that lie behind one another and align with one another also have funnel-shaped widened regions at their ends. Where the four containers abut one another with their corners, the grooves are left out, so that the partial region channels lay themselves around the adjacent shorter side walls of the containers, in each instance.

In another advantageous embodiment of the invention, it is provided, according to claim 4, that the molded part is configured as a pallet, the lateral support elements of which (feet or runners) dip into the containers from above, and support themselves on the container edge with a shoulder.

In this manner, it is possible to replace the usual (wooden) pallet with the molded part according to the invention, and also to set such a pallet onto the containers set onto the lower pallet, from above, as a fixation element.

As an alternative to this, it is provided, according to claim 5, that the molded part is configured in lid-like manner and has a circumferential edge that surrounds the container edges in a downward direction.

Such a molded part is easier to produce and configured to be lighter. Another advantage of this embodiment lies in that the (open) containers are protected against the penetration of wetness and moisture.

In order to completely exclude slipping of the containers to the side, in their formation, the top of the molded part is surrounded by a raised edge.

In general, it should be said that the molded parts can be produced from plastic, using the injection-molding method.

In the following, the invention will be shown using drawings, and explained in greater detail.

The drawings show:

FIG. 1 molded part according to the invention in a first alternative, in a representation from below FIG. 2 molded part according to the invention in a first alternative, from above, before being set on FIG. 3 molded part according to FIG. 2 while being set onto the containers FIG. 4 molded part according to FIGS. 1 to 3 in the set-on state FIG. 5 arrangement according to FIG. 3 in a front view FIG. 6 molded part in the set-on state (front view)

Figure 7:
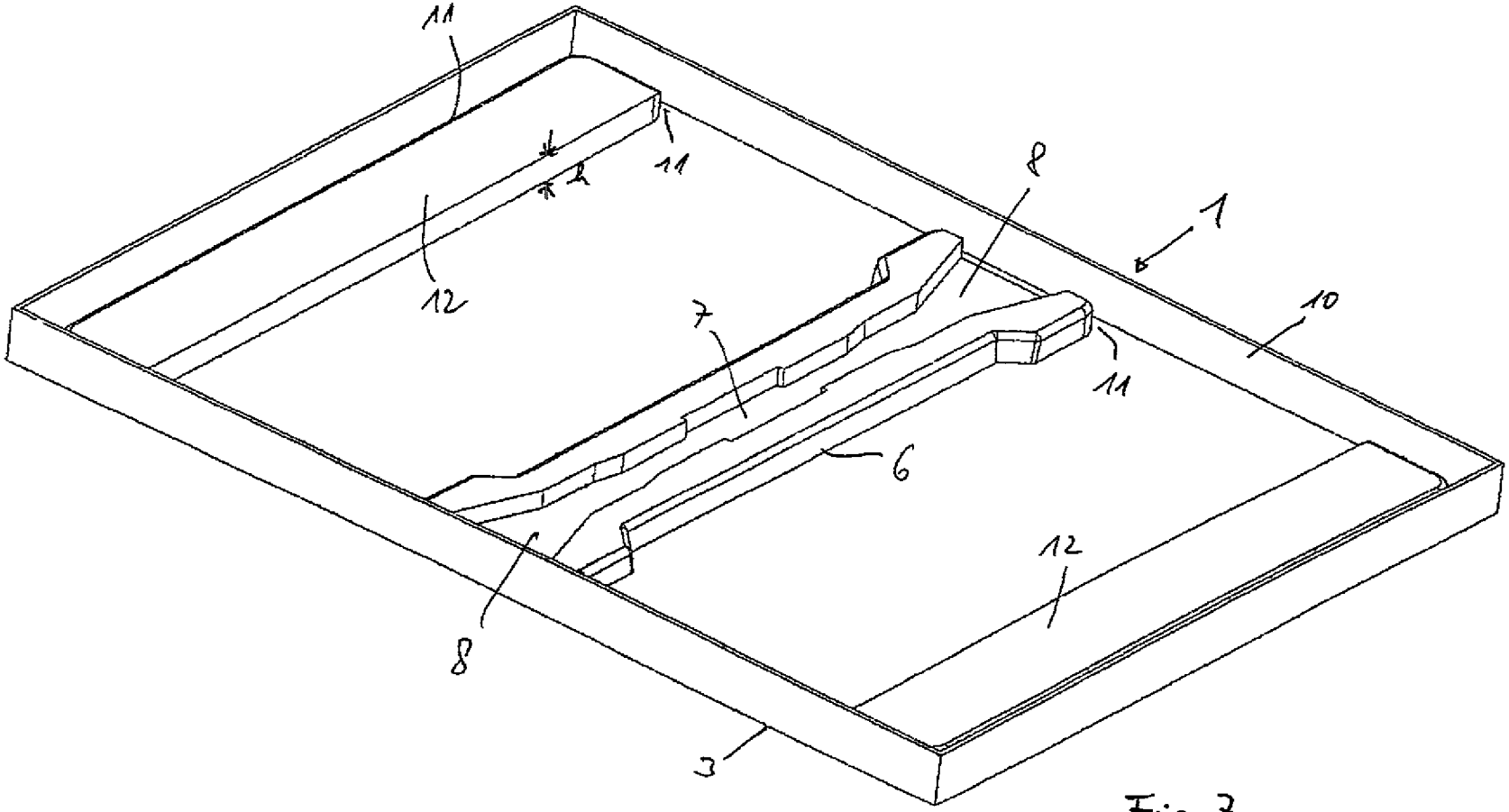

FIG. 7 molded part according to a second alternative, in a view from below

Figure 6:
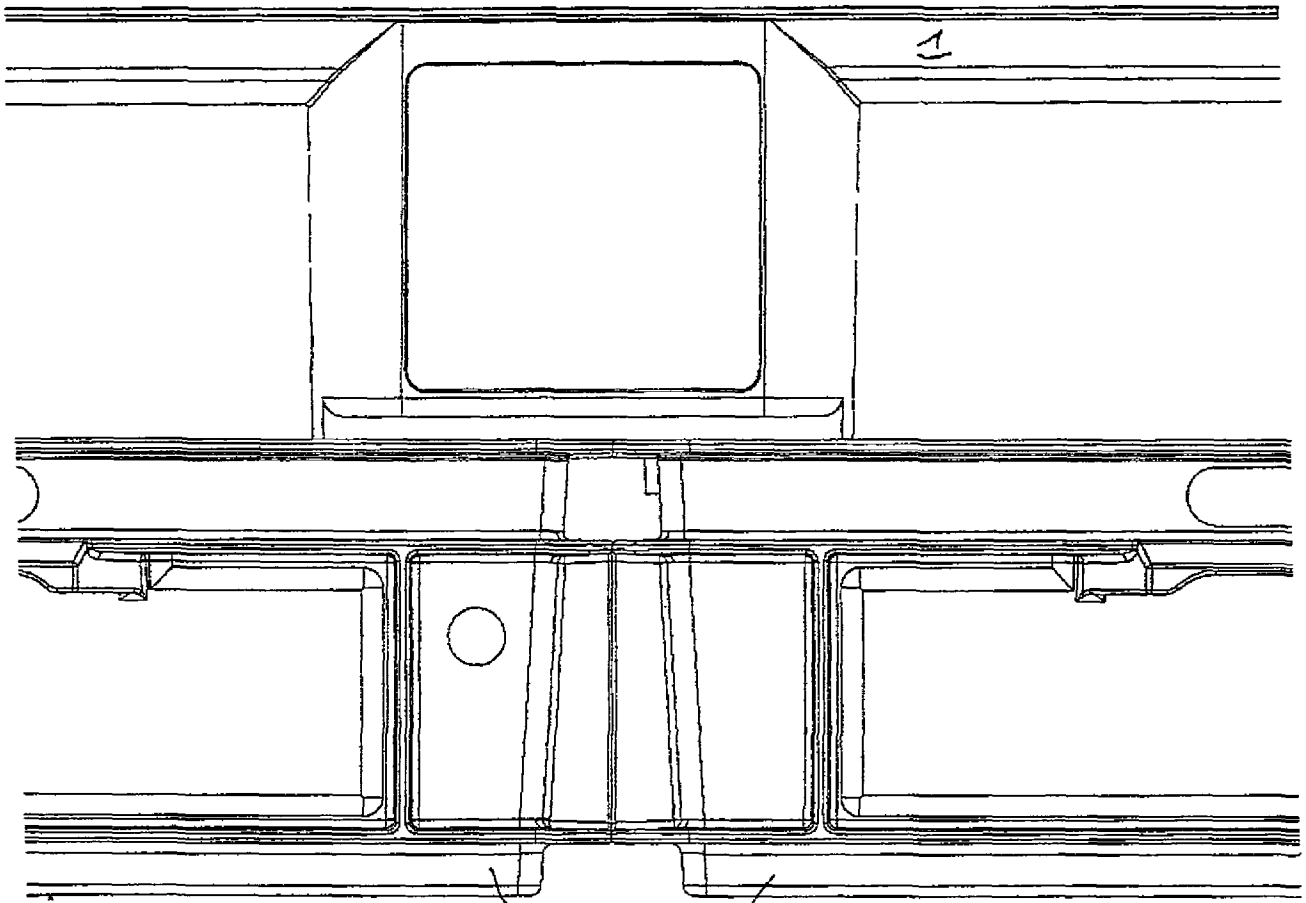
Figure 8:
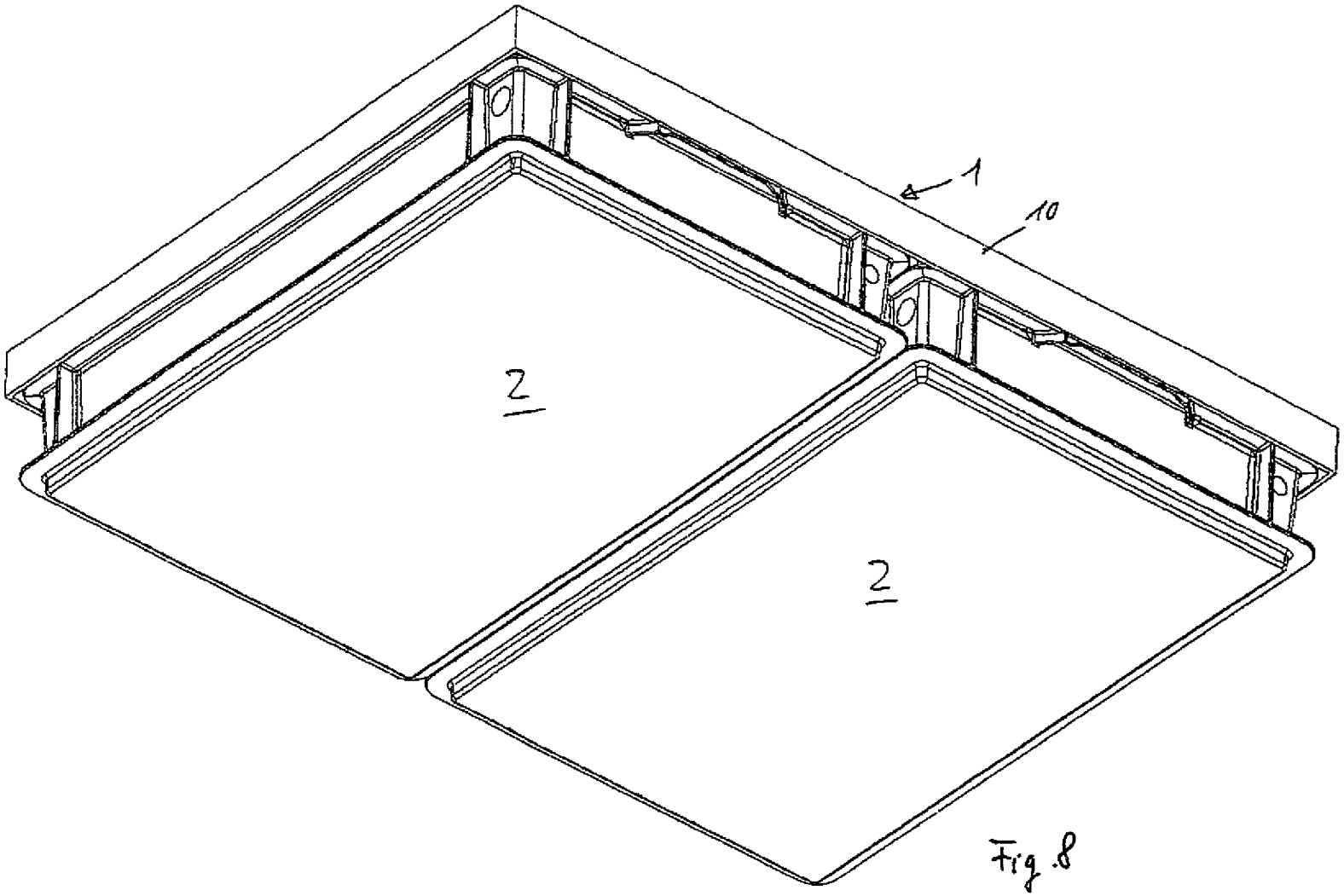

FIG. 8 molded part according to FIG. 6 in the set-on state

Figure 9:
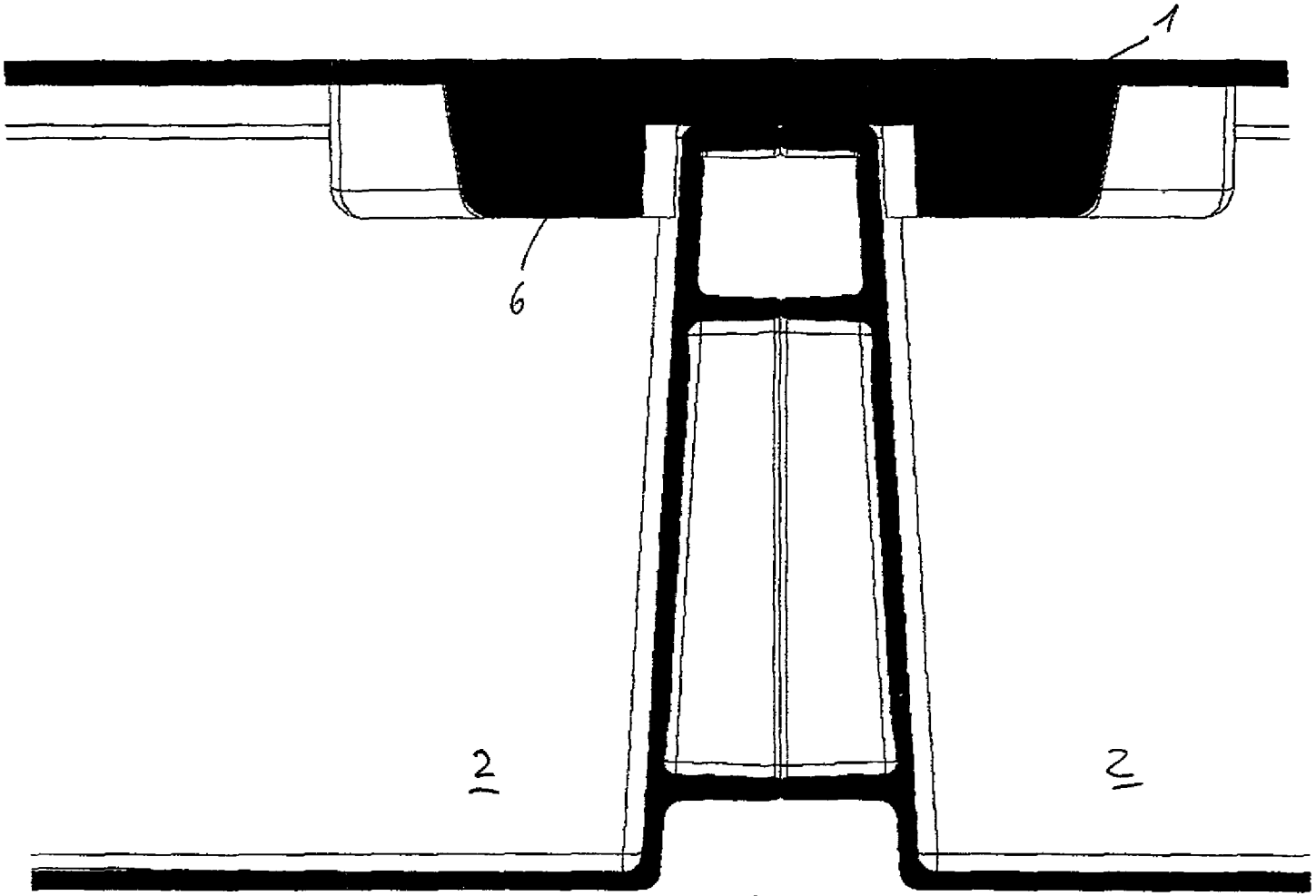

FIG. 9 molded part in the set-on state, in cross-section

In FIG. 1, a molded part for accommodation and fixation of storage containers 2 rectangular in outline is shown, which part is provided, in general, with the reference symbol 1. The molded part 1 is structured in the form of a pallet, which is coordinated with the base surface areas of the containers 2, in terms of its dimensions, in such a manner that in the present case, precisely two containers 2 fit onto the bearing surface 3 of the molded part 1.

In the present representation, the pallet is shown from below, which makes it clear that a runner 4 is formed onto the underside of the contact surface 3, on the two shorter side edges of same. The runners 4 have a circumferential shoulder 5 on the outside in the region of their standing surfaces.

A crosspiece 6 is formed onto the underside of the molded part 1, symmetrical to the center longitudinal axis and parallel to the runners 4, into the surface of which crosspiece a groove-shaped channel 7 is formed, the two ends 8 of which are widened in the shape of a funnel. Ahead of the ends 8 of the channel, in each instance, the crosspiece also has a shoulder 9, the planes of which align with the planes of the shoulders 5 in the runners 4.

Figure 2:
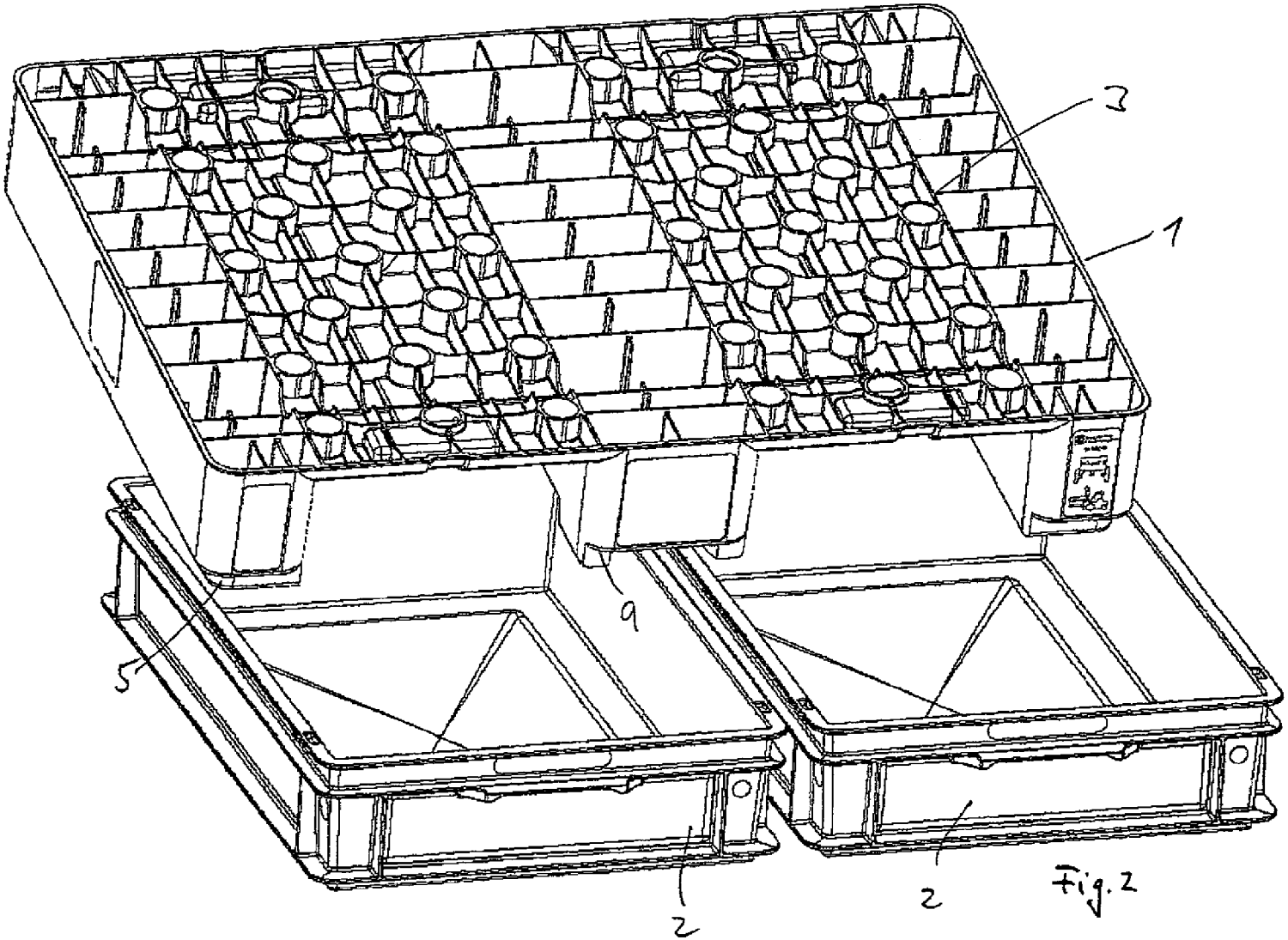

In FIG. 2, the state is shown in which two containers 2 are supposed to be combined by the pallet 1. The containers 2 are situated, for example, on a normal wooden pallet, not shown, whereby the distance between the containers 2 is unimportant. In FIG. 3, the state is shown in which the pallet 1 is set onto the shorter longitudinal walls of the containers 2 with an end 8 of the groove-shaped channel 7 that is widened in funnel shape, in such a manner that the longer side walls of the containers 2, which are adjacent to one another, come to lie in the funnel-shaped widened region of the groove.

By means of folding down the pallet 1 onto the containers 2, the funnel-shaped widened region guides the longer side walls into the groove 7 during the further progression, until the side walls come to lie against one another.

At the same time, in this connection, the shoulders 5 and 9 lay themselves onto the top edges of the container side walls. In this connection, the upper regions of the runners 4 as well as the side regions of the groove 7 dip into the interior of the containers 2. In this manner, secure hold of the containers 2 against one another is guaranteed.

Now, two further containers 2 (not shown) are set onto this combination of containers and pallet 1, and covered and fixed in place with a further pallet in the same manner as described above.

Figure 3:
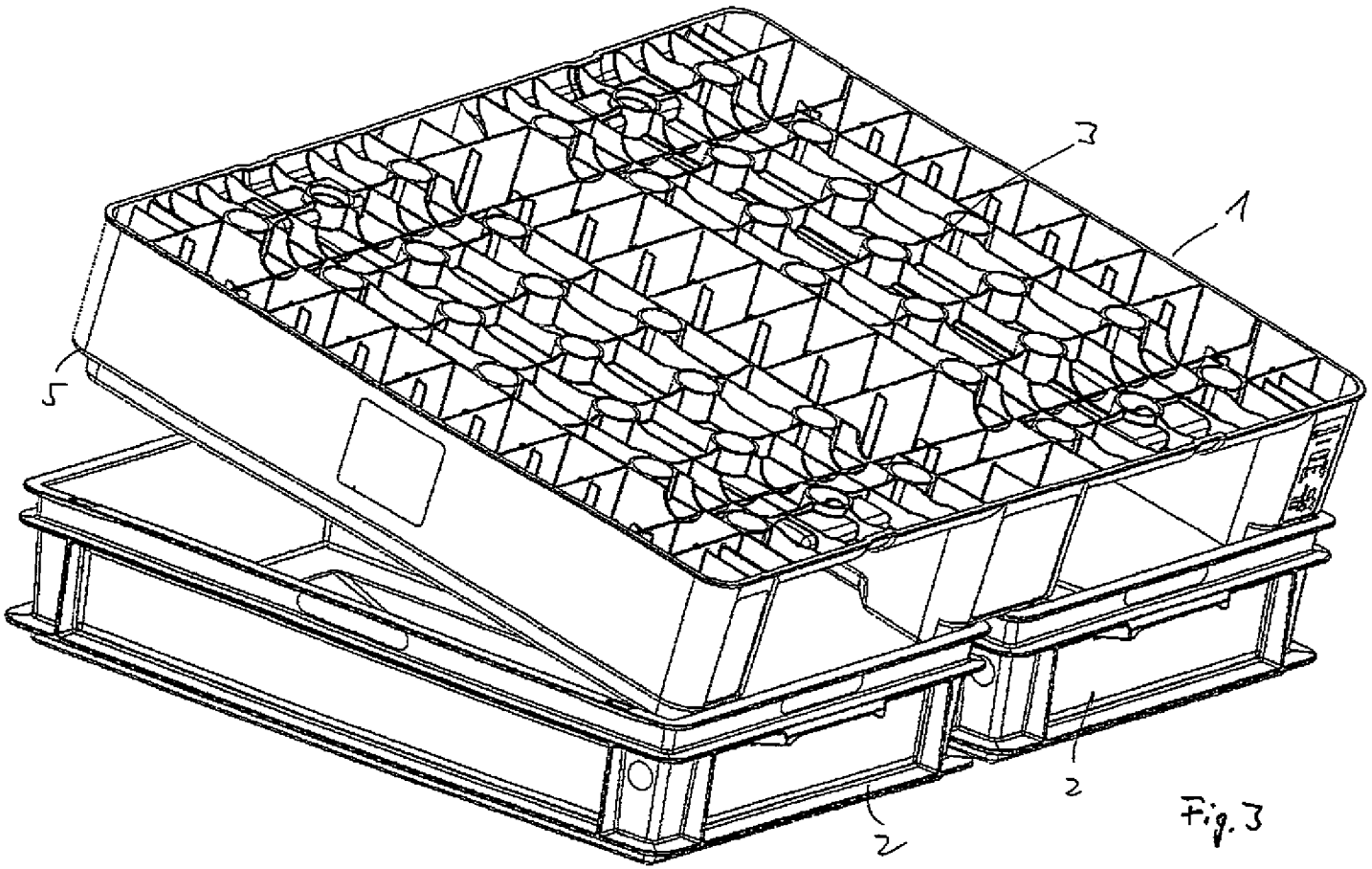
Figure 4:
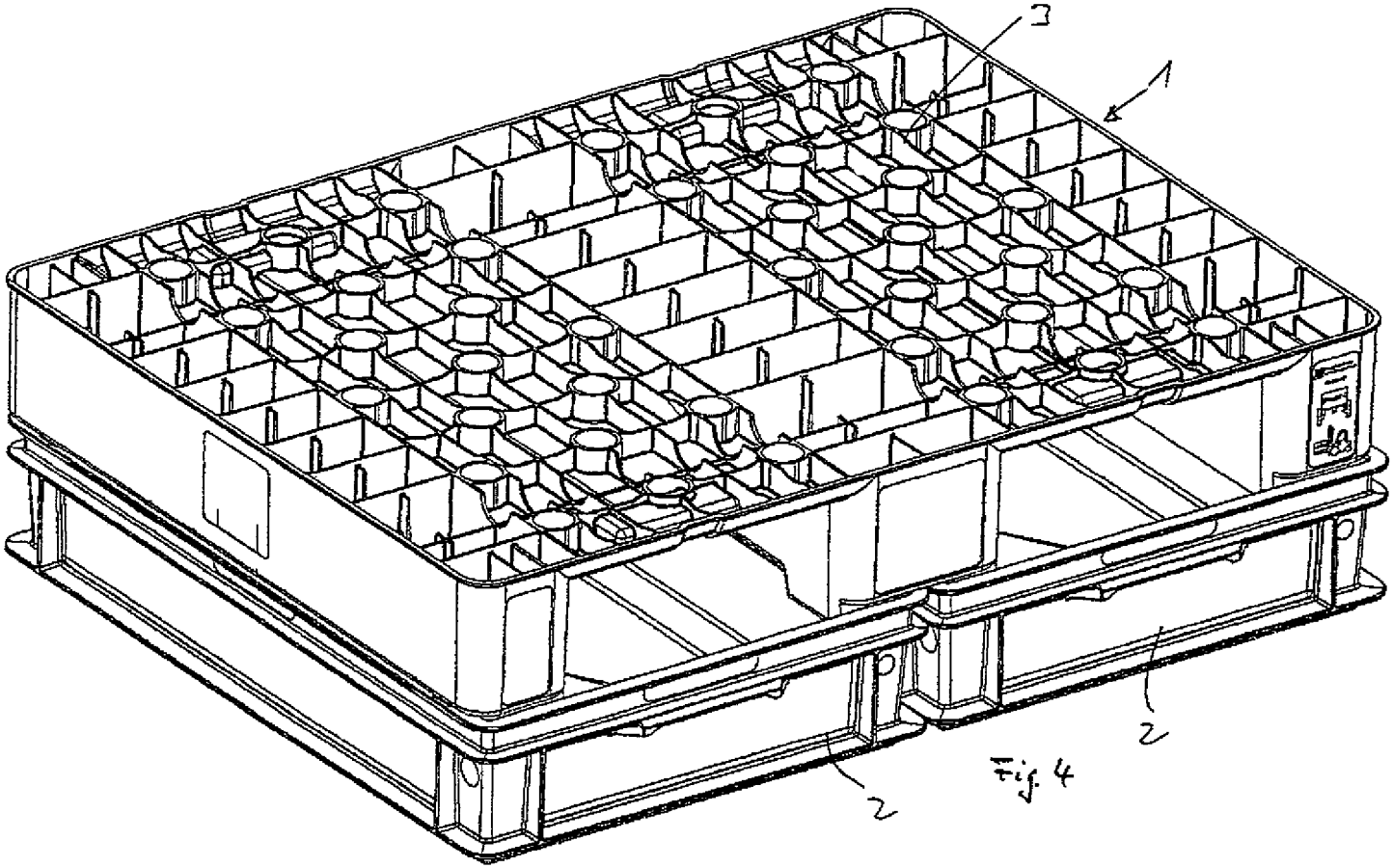
Figure 5:
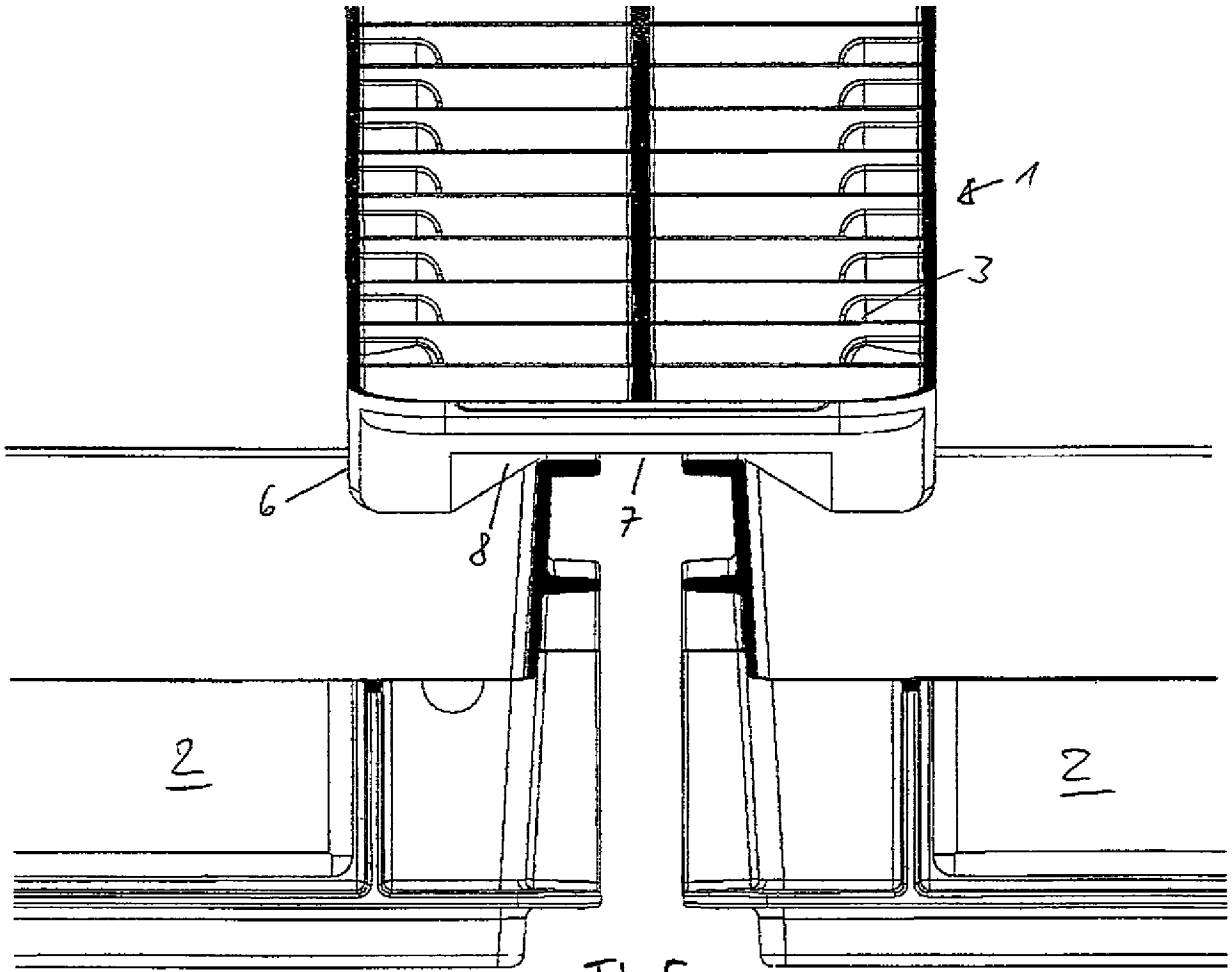

In FIGS. 5 and 6, the state as shown in FIG. 3, on the one hand, and as shown in FIG. 4, on the other hand, is shown, but in a front view, in each instance.

In FIG. 7, an alternative embodiment of the molded part 1 is shown. It has the form of a lid that is coordinated, in terms of its dimensions, also with two of the containers shown above, for example. Here, too, a crosspiece 6 is formed onto the underside of the contact surface 3, into which crosspiece also, as shown in FIG. 1, a channel 7 is formed, which channel also has ends 8 that are widened in funnel shape.

The accommodation surface 3 is surrounded by an edge 10 that is drawn downward, which edge is configured in apron-like manner.

So that the upper edges of the containers can come into contact with the underside of the accommodation surface 3 when this lid-shaped molded part 1 is set onto the two containers 2 to be secured, a corresponding distance 11 is left between the ends of the crosspiece 6 and the inside of the edge 10. A corresponding distance 11 is also left between the edge 10 and formed-out regions 12, which agree, in terms of their height h, with the height of the crosspiece 6. These formed-out regions 12 as well as the side regions of the channel 7 dip into the containers 2 when the lid-shaped molded part 1 is set on.

This state is shown in FIGS. 8 and 9.

The contact surface 3 not only of the pallet-shaped molded part 1 but also of the lid-shaped molded part 1 can be surrounded by a raised edge that projects beyond the accommodation plane, but this is not shown in the drawings. Such an edge gives the accommodated containers 2 an additional hold.

Using the molded parts described above, it is possible to produce a container stack, by means of a combination of the two molded parts, which stack is set onto a pallet-shaped molded part 1 at the lowermost location, whereby then, in the further structure, a lid-shaped molded part 1, in each instance, can be disposed between the containers 2.

The invention is not restricted to being able to set only two containers 2 onto each molded part 1. It is also possible that four containers 2 are secured and accommodated by the molded parts 1, whereby two of these containers, in each instance, correspond, in terms of their base surface area, to the base surface area of a container as shown in the drawing.

In this case, the crosspiece 6 is interrupted in the middle, so that two channels 7 are formed, which align with one another, and whereby each of these channels 7 is also widened in funnel shape at both ends 8.

When a molded part configured in this manner is set onto the four containers 2 set onto a pallet or a corresponding molded part 1, the four containers are automatically centered and held, whereby naturally, in the case of a molded part 1 in pallet form, the runners 4 must also have a recess in their center region. The same holds true for the formed-out regions 12 in the case of a molded part 1 in the form of a lid.

The invention claimed is:

1. A storage container system comprising a plurality of rectangular storage containers and a molded part configured for accommodation and fixation of the storage containers, wherein an accommodation surface of the molded part is an even-numbered multiple of the container surface area, and two containers are disposed adjacent to one another, in such a manner that side walls of the containers that face one another lie symmetrical to a short center longitudinal axis of the molded part, wherein a groove that brings together and encloses the side walls that face one another of two adjacent storage containers disposed below the molded part is provided on an underside of the molded part, wherein the groove faces away from the accommodation surface, and extends in a progression of the center longitudinal axis, the side edges of the groove reaching into the containers, and wherein a channel that forms the groove has ends that are widened in a funnel-like manner along the center longitudinal axis.

2. The storage container system according to claim 1, wherein two grooves are provided in the center longitudinal axis, one behind the other and aligning with one another, and wherein a region between the channels that form the grooves is left out.

3. The storage container system according to claim 1, wherein the molded part is configured as a pallet having lateral support elements that dip into the containers from above, and support themselves on the container edge with a shoulder.

4. The storage container system according to claim 1, wherein the molded part is configured in lid-like manner and has a circumferential edge that surrounds the container edges from above.

5. The storage container system according to claim 1, wherein the accommodation surface of the molded part is surrounded by an edge that rises vertically beyond a plane of the accommodation surface.

* * * * *